US008800335B2

(12) United States Patent
Kang et al.

(10) Patent No.: US 8,800,335 B2
(45) Date of Patent: Aug. 12, 2014

(54) METHOD OF MANUFACTURING FLANGE FOR WIND TOWERS USING RING ROLLING METHOD

(75) Inventors: Jong-hoon Kang, Busan (KR); Hyun-jun Kim, Busan (KR); Hong-il Jo, Busan (KR); Young-myung Kim, Gimhae-si (KR)

(73) Assignee: PMS, Inc. (KR)

( * ) Notice: Subject to any disclaimer, the term of this patent is extended or adjusted under 35 U.S.C. 154(b) by 223 days.

(21) Appl. No.: 13/414,844

(22) Filed: Mar. 8, 2012

(65) Prior Publication Data

US 2013/0205857 A1 Aug. 15, 2013

(30) Foreign Application Priority Data

Feb. 13, 2012 (KR) ..... 10-2012-0014426

(51) Int. Cl.
*B21D 22/00* (2006.01)
*B21D 22/16* (2006.01)

(52) U.S. Cl.
USPC ..... 72/107; 72/84

(58) Field of Classification Search
USPC ..... 72/84, 102, 105–110
See application file for complete search history.

(56) References Cited

U.S. PATENT DOCUMENTS

| | | | | | |
|---|---|---|---|---|---|
| 3,230,606 | A | * | 1/1966 | Saito et al. | 72/106 |
| 3,434,322 | A | * | 3/1969 | Cowles et al. | 72/107 |
| 3,681,962 | A | * | 8/1972 | Marcovitch | 72/106 |
| 5,605,068 | A | * | 2/1997 | Yamasoto et al. | 72/105 |
| 5,882,123 | A | * | 3/1999 | Lee et al. | 72/106 |

FOREIGN PATENT DOCUMENTS

| | | | |
|---|---|---|---|
| KR | 10-2006-0066629 | A | 6/2006 |
| KR | 10-2011-0088175 | A | 8/2011 |
| KR | 10-1188605 | B1 | 10/2012 |

* cited by examiner

*Primary Examiner* — Teresa M Ekiert
(74) *Attorney, Agent, or Firm* — Park & Associates IP Law, P.C.

(57) ABSTRACT

Disclosed herein is a method of manufacturing a flange for wind towers through a ring rolling process. The ring rolling process makes use of a ring rolling machine. The ring rolling machine includes a main roll which presses a circumferential outer surface of a blank, a pressure roll which presses a circumferential inner surface of the blank, and a pair of axial rolls which press upper and lower surfaces of the blank. The method includes expanding an inner diameter and outer diameter of the blank using the ring rolling machine, transferring the pressure roll vertically so that a protrusion provided on a circumferential outer surface of the pressure roll comes into contact with the circumferential inner surface of the blank, and forming a depression in the circumferential inner surface of the blank using the protrusion of the pressure roll.

2 Claims, 4 Drawing Sheets

METHOD OF MANUFACTURING FLANGE FOR WIND TOWERS USING RING ROLLING METHOD

REFERENCE TO RELATED APPLICATIONS

This application claims the priority benefit of Korean Patent Application No. 10-201 2-001 4426 filed on Feb. 13, 2012, the entire contents of which are incorporated herein by reference.

FIELD OF THE INVENTION

The present invention relates generally to methods of manufacturing flanges for wind towers using ring rolling methods and, more particularly, to a method of manufacturing a flange for a wind tower using a ring rolling method, the flange being used to connect tubes that form the framework of the wind tower.

BACKGROUND OF THE INVENTION

Generally, a ring rolling process is a process which machines a seamless ring in a continuous manner into a predetermined size, thus producing a product, that is, a rolled ring product. Such ring rolling processes are used to manufacture ring parts used in a variety of fields, for example, power generation equipment, chemical plants, gas turbines, jet engines, etc.

Compared to a ring forging process which is different from a rolling process, advantages of the ring rolling process include that the working speed is rapid, the temperature can be maintained, the production yield can be enhanced, and so on. Particularly, in the case of a rolled ring product that is manufactured by a ring rolling process, the grain flow line is continuously formed in the circumferential direction of the product, thus providing superior characteristics.

FIG. 1 is of views showing an entire ring rolling process. A method of manufacturing a rolled ring product with the ring rolling process will be explained with reference to FIG. 1. At step S1, an initial billet 1 with, for example, a cylindrical structure, is prepared by cutting off a raw billet to an appropriate size using gas cutting or a machine saw.

Subsequently, at step S2, a heating furnace 2 heats the initial billet 1 to the desired temperature. At step S3, the heated initial billet 1 is transferred to a forging press 3.

A mold of the forging press 3 that has been preheated upset-forges the heated initial billet 1, thus pressing the initial billet 1 in the axial direction, at step S4.

Thereafter, at step S5, a punch 4 pierces an intermediate product 1*a* that has been compressed by upset-forging the initial billet 1, thus forming a hollow blank 9.

At step S6, a ring rolling machine subsequently ring-rolls the blank 9. The ring rolling machine includes a main roll 5 which presses a circumferential outer surface of the blank 9, a pressure roll 6 which presses a circumferential inner surface of the blank 9, an upper axial roll 7 which presses an upper surface of the blank 9, a lower axial roll 8 which presses a lower surface of the blank 9, and a plurality of guide rolls 10 which rotatably support the circumferential outer surface of the blank 9. This ring rolling process produces a rolled ring product 11 into a predetermined shape, at step S7.

Particularly, a flange, which is used to connect tubes that form the framework of a wind tower, is typically manufactured by such a ring rolling process. FIG. 2 is a sectional view of a typical flange for wind towers.

As shown in FIG. 2, the flange 10 for wind towers includes a connection part 10*a* that protrudes from the body of the flange 10 and is used when welding a corresponding tube to the flange 10. Producing the flange 10 includes the ring rolling process manufacturing a ring having a rectangular cross-section as illustrated in FIG. 1, and post-processing the ring, thus producing a final product.

FIG. 3 is a sectional view of a ring-rolled product having a depression. Recently, as shown in FIG. 3, a method is used in which an intermediate product having a depression 12 in a circumferential inner surface thereof is formed, the intermediate product is cut into two parts at a medial portion thereof corresponding to the depression 12, and then each of the two parts is post-processed, thus forming a final product 10.

Representative examples of the above conventional technique were proposed in Korean Patent Application No. 10-2009-0131482 (filed on Dec. 28, 2009: Semi-finished ring rolling machine and method of manufacturing semi-finished ring using the same), Patent Application No. 10-2010-0007954 (filed on Jan. 28, 2010: Apparatus and method for manufacturing asymmetric large ring), etc.

However, to form such a product having a depression, a protrusion must be provided on the pressure roll.

FIGS. 4A and 4B are sectional views comparing the shapes of blanks depending on the presence of the protrusion.

FIG. 4A illustrates the case of a typical pressure roll having no protrusion. FIG. 4B illustrates the case of a pressure roll provided with a protrusion. As shown in FIGS. 4A and 4B, compared to the case (FIG. 4A) of the typical pressure roll, a disadvantage of the case (FIG. 4B) of the pressure roll provided with the protrusion is that the inner diameter of the blank is increased ($d1<d2$), so that the diameter of a punch that is used to pierce the blank must also be increased, and the material utilization ratio is reduced.

SUMMARY OF THE INVENTION

Accordingly, the present invention has been made keeping in mind the above problems occurring in the prior art, and an object of the present invention is to provide a method of manufacturing a flange for a wind tower using a ring rolling method which makes use of a blank, the inner diameter of which can be the same as that of the conventional technique, so that the material utilization ratio can be prevented from being reduced.

In order to accomplish the above object, the present invention provides a method of manufacturing a flange for wind towers through a ring rolling process using a ring rolling machine including a main roll pressing a circumferential outer surface of a blank, a pressure roll pressing a circumferential inner surface of the blank, and a pair of axial rolls pressing upper and lower surfaces of the blank, the method including, expanding an inner diameter and outer diameter of the blank using the ring rolling machine, transferring the pressure roll vertically so that a protrusion provided on a circumferential outer surface of the pressure roll comes into contact with the circumferential inner surface of the blank, and forming a depression in the circumferential inner surface of the blank using the protrusion of the pressure roll.

In the forming the depression, when a thickness of the blank 9 varies from S1 to S2, a cross-sectional area A1 of the protrusion and a cross-sectional area A2 of the depression satisfy Equation (a), where Equation (a) is $S1>S2(1+A1/A2)$.

In the forming the depression, a thickness S1 and height T1 of the blank and a thickness S2 and height T2 of a final product satisfy Equation (b), where Equation (b) is $T1^2-S1^2=T2^2-S2^2$.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Hereinafter, a preferred embodiment of the present invention will be described in detail with reference to the attached drawings.

Figure 5A:
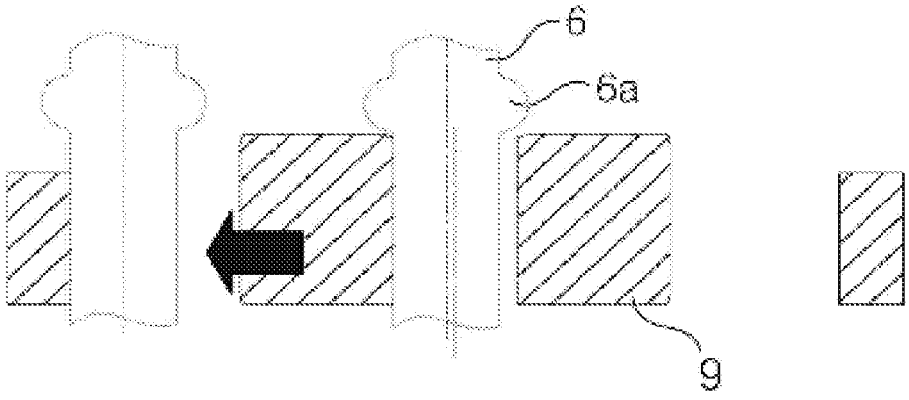
FIGS. 5A, 5B and 5C are views showing a method of manufacturing a flange for a wind tower through a ring rolling process, according to a preferred embodiment of the present invention.
Figure 5B:
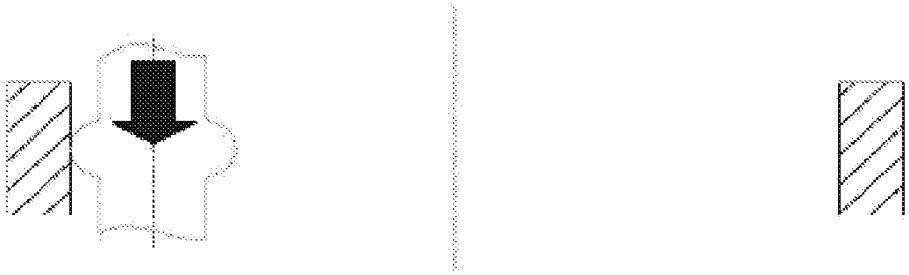
Figure 5C:
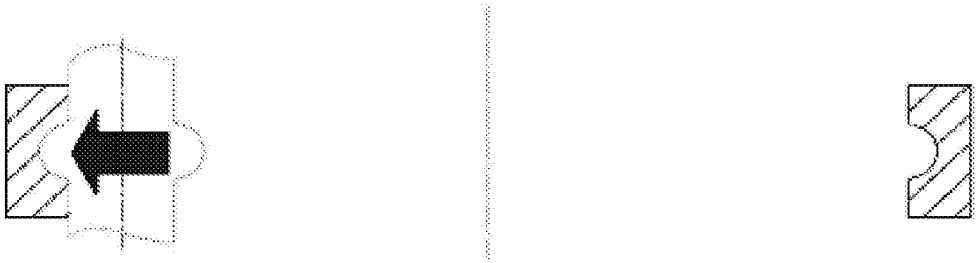

FIGS. 5A, 5B and 5C are views successively showing a method of manufacturing a flange for wind towers through a ring rolling process, according to the preferred embodiment of the present invention.

Figure 1:
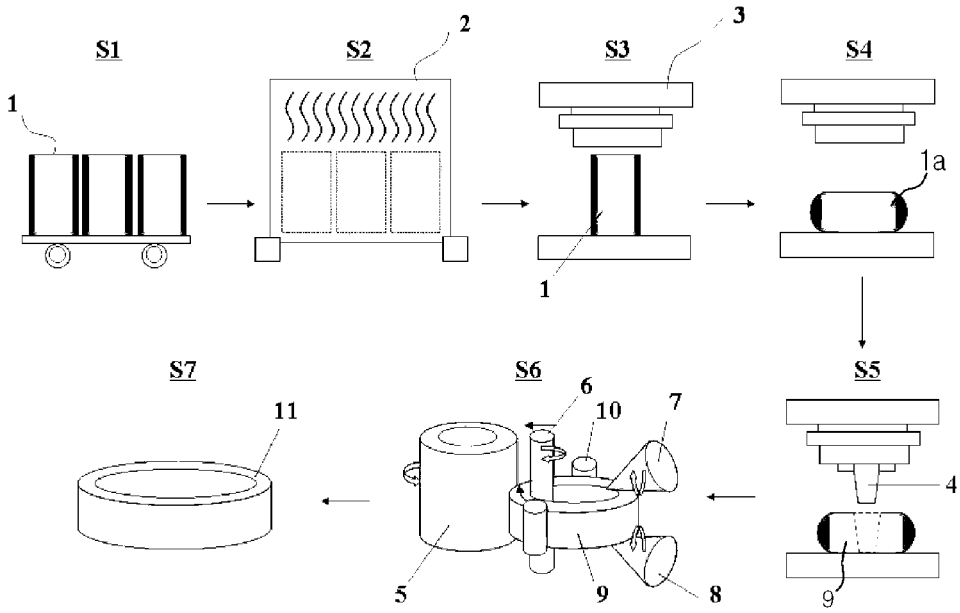
FIG. 1 (Related Art)
FIG. 1 is of views showing a ring rolling process in its entirety.
Figure 2:
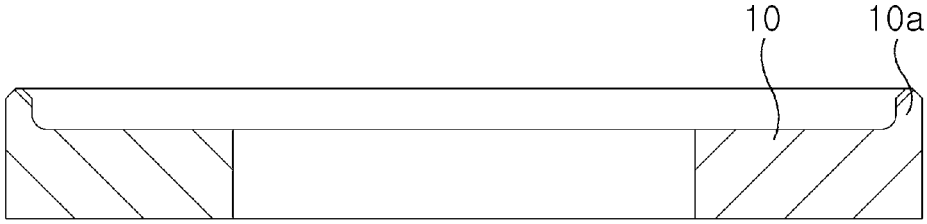
FIG. 2 (Related Art)
FIG. 2 is a sectional view showing a flange for a wind tower.
Figure 3:
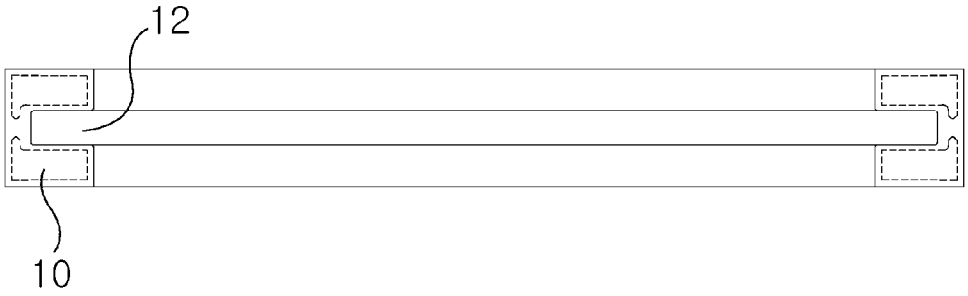
FIG. 3 (Related Art)
FIG. 3 is a sectional view of a ring-rolled product having a depression.

As shown in FIGS. 5A through 5C, the method of manufacturing the flange for the wind tower through the ring rolling process according to the present invention makes use of a ring rolling machine that has the same structure as that of FIG. 1. The ring rolling machine includes a main roll which presses the circumferential outer surface of a blank, a pressure roll which presses the circumferential inner surface of the blank, and a pair of axial rolls which press upper and lower surfaces of the blank.

As shown in FIG. 5, the method of manufacturing the flange using the ring rolling machine includes expanding (FIG. 5A) the inner and outer diameters of the blank 9, transferring (FIG. 5B) the pressure roll 6 vertically so that a protrusion 6*a* provided on a circumferential outer surface of the pressure roll 6 comes into contact with the circumferential inner surface of the blank 9, and forming (FIG. 5C) a depression 9*a* in the circumferential inner surface of the blank 9 using the protrusions 6*a* provided on the circumferential outer surface of the pressure roll 6.

Basically, the ring rolling method used in the present invention is the same as the conventional ring rolling method.

Figure 4A:
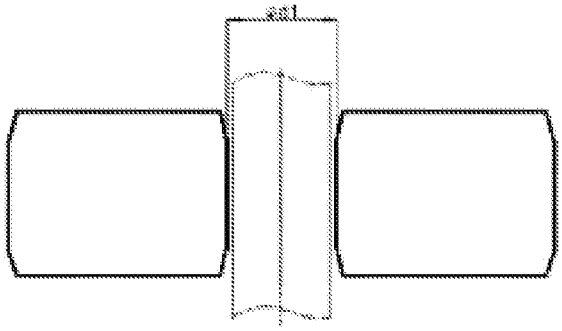
FIG. 4A (Prior Art)
FIGS. 4A and 4B are sectional views comparing the shapes of blanks depending on the presence of a protrusion.
Figure 4B:
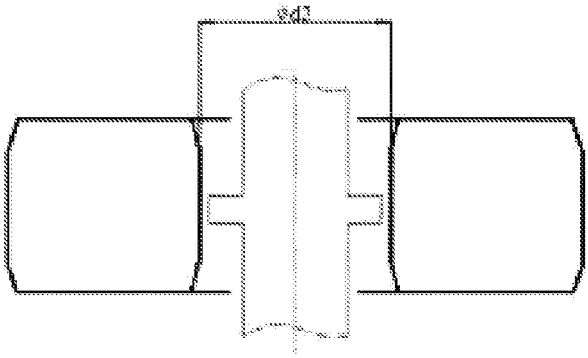
FIG. 4B (Prior Art)

However, unlike the conventional method, in the present invention, even if the pressure roll provided with the protrusion is used as shown in FIG. 4B, the blank used can have an inner diameter that is the same as that of the case wherein the pressure roll having no protrusion is used, as illustrated in FIG. 5A. Thus, the size of a punch can be reduced, and the material utilization ratio can be enhanced.

The important factors of the present invention are the timing and speed at which the pressure roll 6 moves downwards.

If a point in time at which the pressure roll moves downwards is comparatively early, the time for which the pressure roll 6 is in contact with a high temperature material becomes long, thus causing heat-deterioration of the pressure roll 6, and reducing its lifetime. Therefore, the pressure roll 6 needs to be moved after the blank 9 has been formed in dimensions as close as possible to the desired final dimensions.

The timing at which the pressure roll moves downwards is determined by the thickness of a final product and the height and thickness of the depression of the product.

Figure 6:
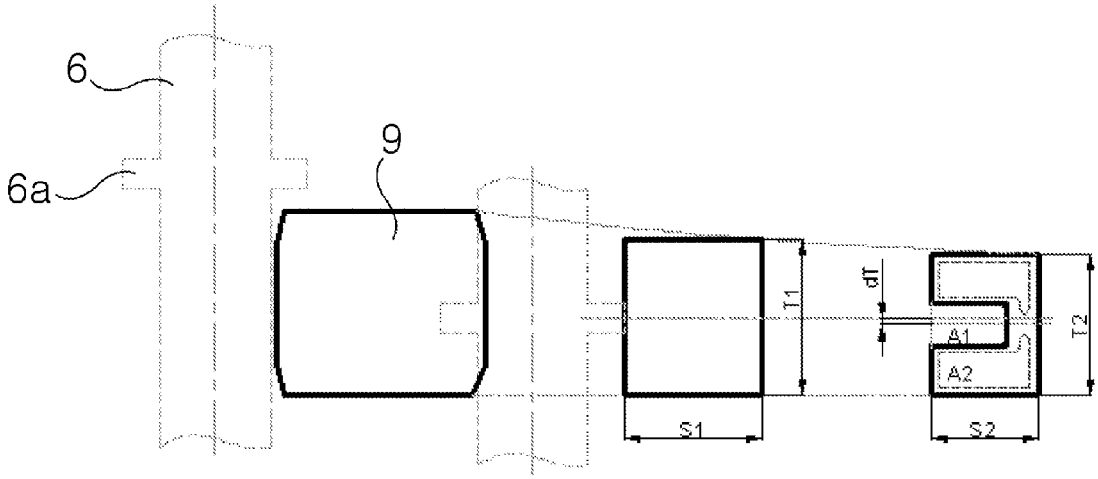
FIG. 6 is a conceptual view illustrating timing at and a method by which a pressure roll is moved according to the preferred embodiment of the present invention.

FIG. 6 is a concept view illustrating the timing of and a method by which a pressure roll is moved according to the preferred embodiment of the present invention.

As shown in FIG. 6, a thickness S1 of the blank 9 before the pressure roll 6 moves downwards is greater than a thickness S2 of a final product.

Here, in forming the depression, as the thickness of the blank 9 changes from S1 to S2, a cross-sectional area A1 of the protrusion and a cross-sectional area A2 of the depression must satisfy the Equation (a) of: $S1>S2(1+A1/A2)$.

In other words, as the volume of the depression increases, the possibility of separating the material from the main roll is increased. Therefore, there must be a margin in the thickness of the blank 9 when forming the depression so that the circumferential outer surface of the pressure roll 6 can be brought into contact with the circumferential inner surface of the blank 9.

Furthermore, in forming the depression, the thickness S1 and height T1 of the blank 9 and the thickness S2 and height T2 of the final product must satisfy the Equation (b) of: $T12-S12=T22-S22$.

Equation (b) can be obtained under the conditions of volume constancy of a metal material. From this equation, the timing at which the pressure roll 6 must move downwards, and the inner and outer diameters of the blank 9 can be obtained.

The method of manufacturing a flange for wind towers using the ring rolling process according to the present invention is adapted to form a flange for wind towers that includes a connection part and which has a rectangular cross-section, the width of which is less than the height.

In detail, manufacturing a flange for wind towers includes forging a blank, primarily-forming a rectangular cross-sectional ring product using the ring rolling method of the present invention, moving the pressure roll, and forming a final product having a depression using the pressure roll.

Unlike the conventional ring rolling method including the primary heating, the rough-shaping, the secondary heating, the primary ring milling, the tertiary heating and the secondary ring milling, the manufacturing method according to the present invention can skip the tertiary heating, thus markedly reducing the production time and cost.

As described above, in a method of manufacturing a flange for wind towers through a ring rolling process according to the present invention, after a portion of a pressure roll other than a protrusion forms a blank into a predetermined size, the pressure roll is moved vertically and then the protrusion of the pressure roll forms the blank. Therefore, the present invention can enhance the material utilization ratio.

Furthermore, the method of manufacturing the flange for wind towers using the ring rolling process according to the present invention can successively carry out a secondary process of forming a depression without conducting a separate heating process after the primary process of forming the blank into a predetermined size. Hence, the present invention can increase productivity, reduce the production cost, and solve the problems of a central portion not being filled with material, a product being distorted, etc.

The main technical spirit of the present invention is to provide a method of manufacturing a flange for wind towers using a ring rolling process. Although the preferred embodiment of the present invention has been disclosed for illustrative purposes, those skilled in the art will appreciate that various modifications, additions and substitutions are possible, and the scope and spirit of the invention must be defined by the accompanying claims.

What is claimed is:

1. A method of manufacturing a flange through a ring rolling process using a ring rolling machine which includes a main roll for pressing a circumferential outer surface of a blank, a pressure roll for pressing a circumferential inner surface of the blank, and a pair of axial rolls for pressing upper and lower surfaces of the blank, the method comprising:

expanding by ring rolling an inner diameter and outer diameter of the blank using the ring rolling machine;

transferring the pressure roll vertically so that a protrusion provided on a circumferential outer surface of the pressure roll comes into contact with the circumferential inner surface of the blank; and forming by ring rolling a depression in the circumferential inner surface of the blank using the protrusion of the pressure roll, wherein in said forming the depression, as a thickness of the blank changes from S1 to S2, a cross-sectional area A1 of the protrusion and a cross-sectional area A2 of the depression satisfy Equation (a), where Equation (a) is $S1>S2(1+A1/A2)$.

2. A method of manufacturing a flange through a ring rolling process using a ring rolling machine which includes a main roll for pressing a circumferential outer surface of a blank, a pressure roll for pressing a circumferential inner surface of the blank, and a pair of axial rolls for pressing upper and lower surfaces of the blank, the method comprising:

expanding by ring rolling an inner diameter and outer diameter of the blank using the ring rolling machine;

transferring the pressure roll vertically so that a protrusion provided on a circumferential outer surface of the pressure roll comes into contact with the circumferential inner surface of the blank; and forming by ring rolling a depression in the circumferential inner surface of the blank using the protrusion of the pressure roll, wherein in said forming the depression, a thickness S1 and a height T1 of the blank and a thickness S2 and a height T2 of a final product satisfy Equation (b), where Equation (b) is $T1^2-S1^2=T2^2-S2^2$.

* * * * *